US007582841B2

(12) United States Patent
Kim

(10) Patent No.: US 7,582,841 B2
(45) Date of Patent: Sep. 1, 2009

(54) CONTROL BUTTON OF DRUM TYPE WASHING MACHINE

(75) Inventor: Chang Hoo Kim, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 11/959,884

(22) Filed: Dec. 19, 2007

(65) Prior Publication Data

US 2008/0148787 A1 Jun. 26, 2008

(30) Foreign Application Priority Data

Dec. 20, 2006 (KR) ..... 10-2006-0131337

(51) Int. Cl.
*D06F 33/00* (2006.01)
*H01H 3/08* (2006.01)

(52) U.S. Cl. ..... 200/566; 68/3 R; 68/12.23

(58) Field of Classification Search ..... 68/235 R, 68/3 R, 12.23; 219/217; 200/566, 341
See application file for complete search history.

(56) References Cited

FOREIGN PATENT DOCUMENTS

FR 2698459 A1 * 5/1994
GB 2236380 A * 4/1991
JP 03005625 A * 1/1991
KR 10-2006-0114123 * 11/2006

OTHER PUBLICATIONS

Machine Translation of Korean Patent Application Publication No. KR10-2006-0114123 to Kim, Nov. 2006.*
Machine Translation of French Patent Application Publication No. FR2698459A1 to Dominique et al., May 1994.*
Machine Abstract Translation of Japanese Patent Application Publication No. JP03005625A to Suzuki, Jan. 1991.*

* cited by examiner

*Primary Examiner*—Joseph Perrin
*Assistant Examiner*—Benjamin Osterhout
(74) *Attorney, Agent, or Firm*—Occhiuti Rohlicek & Tsao LLP

(57) ABSTRACT

Disclosed herein is a control button of a drum type washing machine. The control button comprises a button securing part, a button operating part, an elastic member, and a cylindrical button provided to a control panel. The button securing part includes a securing body having a fitting hole formed at the center thereof, a securing portion having a rack formed on an outer surface thereof, and a coupling hole coupled to the rotary switch. The button operating part includes an operating portion having an operating trough and a pinion corresponding to the rack to allow the securing portion to be coupled to the operating portion, a guide member formed on one side of the operating portion, and an operating body integral to one side of the guide member and operating portion. The operating body is press-fitted into the button adjusting part that is provided to a control panel.

8 Claims, 6 Drawing Sheets

CONTROL BUTTON OF DRUM TYPE WASHING MACHINE

CROSS-REFERENCES TO RELATED APPLICATIONS

The present application claims priority to Korean patent application number 10-2006-0131337, filed on Dec. 20, 2006, which is incorporated by reference in its entirety.

BACKGROUND OF THE INVENTION

1. Field of the Invention

The present invention relates to a drum type washing machine, and more particularly to a control button of a drum type washing machine that can be retracted inside a control panel after use of the control button or when manipulation thereof is not required.

2. Description of the Related Art

Generally, a drum type washing machine is constructed such that a washing operation can be performed by lifting and dropping laundry in a cylindrical drum while rotating the drum about a horizontal axis inside a washing tub. The drum type washing machine has merits in that it experiences lower laundry damage resulting from laundry twisting and employs a smaller amount of water for the washing operation, as compared to an agitator type washing machines.

FIG. 1 is a perspective view illustrating a conventional drum type washing machine A, which includes a cabinet having a front cover 100. The washing machine A has a large door 110 coupled to a front central region of the front cover 100. The door 110 is selectively openable to permit a user to input or output laundry therethrough, and to allow a user to confirm a washing state of the laundry. A detergent drawer 120 is provided that is capable of being drawn out forward at one side of an upper portion of the washing machine to contain detergent and laundering additives such as fabric softener.

Additionally, at one side of the detergent drawer 120, the washing machine A is provided with a plurality of buttons 140 for selecting and controlling functions and operations of the washing machine A, a control button 150 for selecting one of various washing cycles, and a control panel 130 which includes a display device 160 for displaying the washing state of the laundry.

A printed circuit board (not shown) is coupled to the rear side of the control panel 130, and includes a rotary switch (not shown) capable of being rotated through manipulation of the control button 150 and other components. The printed circuit board is an electronic component that is connected to a microcomputer for controlling the operation of the washing machine, and receives input signals relating to the washing cycles or provides signals relating to the washing states.

FIG. 2 is a cross-sectional view illustrating a coupled state of the control button and the printed circuit board of the conventional washing machine. The printed circuit board 170 attached to the rear side of the control panel 130 has a rotary switch 180 that is an electronic component for selectively inputting one of the various washing cycles, such as a standard cycle, wool/lingerie cycles, and the like. The control button 150 for manipulating the rotary switch 180 is coupled to one end of the rotary switch 180 outside the control panel 130.

The control button 150 includes a body 152 protruding from the control panel 130, and a fastening part 154 integral to the rear side of the body 152 and coupled to the rotary switch 180.

Since the body 152 of the control button 150 protrudes from the control panel 130, however, it is possible to inadvertently change the selected washing cycle through accidental contact with the control button 150. Moreover, the control button 150 can be damaged in the event where the contact causes a large impact to the control button 150.

Therefore, there is a need to provide an improved drum type washing machine that overcomes such problems.

SUMMARY OF THE INVENTION

The present invention is conceived to solve the problems of the conventional techniques as described above, and an aspect of the present invention is to provide a control button of a drum type washing machine that can be retracted inside a control panel after use of the control button or when manipulation thereof is not required.

In accordance with one aspect of the present invention, this and other objects can be accomplished by the provision of a control button of a control panel for manipulating a rotary switch, the control button comprising: a button securing part, including a securing body having a fitting hole formed at a center of the securing body, a securing portion extending from one side of the securing body and having a rack formed on an outer surface of the securing portion, and a coupling hole formed inside the securing portion so as to be in communication with the fitting hole, the coupling hole being coupled to the rotary switch; a button operating part, including an operating portion open at one end and having an operating trough and a pinion corresponding to the rack disposed inside the operating portion, a guide member disposed at one side of the operating portion, and an operating body integral to one end of the guide member and to an opposed end of the operating portion; an elastic member having one end mounted between the operating body and the operating portion, and the other end mounted on the button securing part; and a cylindrical button adjusting part provided on the control panel and having the operating body press-fitted into the button adjusting part.

Preferably, the guide member comprises: a guide protruding piece formed at one side of an outer peripheral surface of the operating portion and having a guide-piece guiding portion defined therein; a guide-piece controlling protrusion formed on the guide-piece guiding portion which divides the guide-piece guiding portion, the guide-piece controlling protrusion including a guide groove which faces the operating body, the guide groove having a V-shape such that the guide groove comprises a first slope and a second slope; and a guide-piece having a moving end and a fixed end, the moving end capable of moving along the guide-piece guiding portion to control operation of the button operating part, and the fixed end secured to the button securing part.

More preferably, the guide-piece controlling protrusion has a corner facing the guide-piece and biased to one side of an imaginary straight line extending along a longitudinal axis of the guide-piece.

More preferably, the guide member comprises a secondary guide-piece controlling protrusion formed on a surface of the operating portion so as to contact the operating body while facing the guide groove.

More preferably, the secondary guide-piece controlling protrusion has a corner facing the guide groove and biased to one side from an imaginary straight line extending from a center of the guide groove.

More preferably, the first slope of the guide groove is longer than the second slope.

Preferably, the button securing part, the button operating part, and the button adjusting part are made from a metallic material.

Preferably, the button securing part, the button operating part, and the button adjusting part are made from a synthetic resin.

Preferably, the rack cooperatively engages the pinion such that: the securing portion is coupled to the operating portion; and the speed of the relative motion between the securing portion and the operating portion is governed.

Preferably, the control panel forms a portion of a cabinet of a washing machine such that the rotary switch permits selection of a washing cycle from a plurality of washing cycles.

In accordance with another aspect of the present invention, a control button which manipulates a rotary switch, the rotary switch mounted to a printed circuit board disposed within a control panel, the control button comprising: a button securing part mounted on the control button to the printed circuit board; a button operating part mounted on the button securing part and configured to move relative to the button securing part in a direction normal to the printed circuit board between a retracted position and an extended position; an elastic member disposed between the operating body and the operating portion arranged to bias the button operating part to the extended position; and a cylindrical button adjusting part provided on the control panel, the button adjusting part comprising an annular wall and a closed end which define a button adjusting part interior space, wherein the button operating part is press-fit into the button adjusting part interior space, and the annular wall resides within an opening formed in the control panel such that the closed end is substantially flush with a surface of the control panel when the control button is in the retracted position, and the closed end is positioned outwardly of the surface of the control panel when the control button is in the extended position.

Preferably, the button securing part comprises an elongate guide piece, the button operating part comprises a guiding portion, the guiding portion comprising a guide-piece controlling protrusion disposed at one end of the guiding portion, the guide piece moves within the guiding portion, and the button operating part is maintained in the retracted position relative to the button securing part through engagement of the guide piece with the guide-piece controlling protrusion.

BRIEF DESCRIPTION OF THE DRAWINGS

The above and other objects, features and advantages of the present invention will become apparent from the following description of exemplary embodiments given in conjunction with the accompanying drawings, in which.

DETAILED DESCRIPTION OF THE INVENTION

Figure 1:
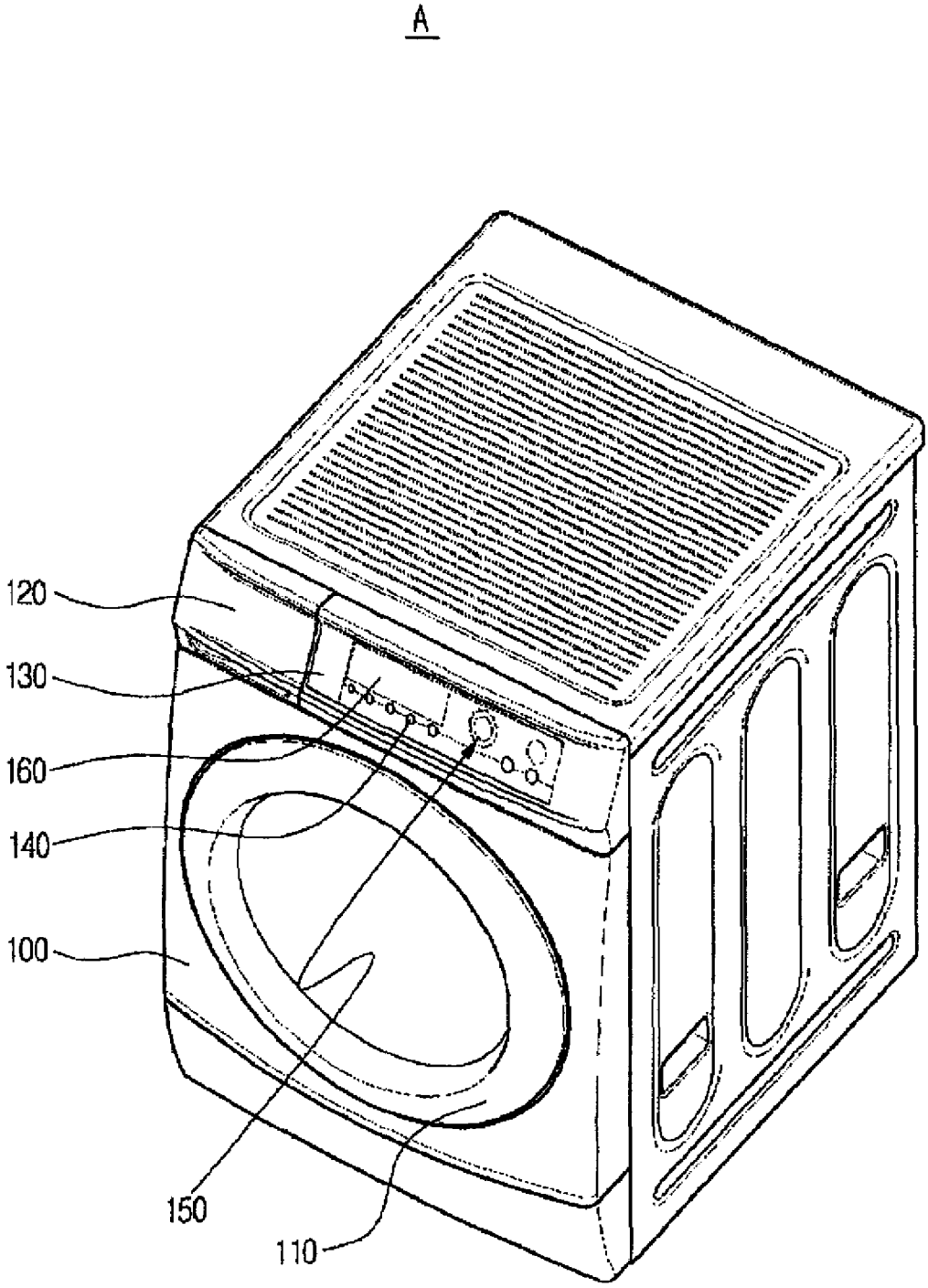
FIG. 1 (PRIOR ART)
FIG. 1 is a schematic perspective view of a conventional drum type washing machine.
Figure 2:
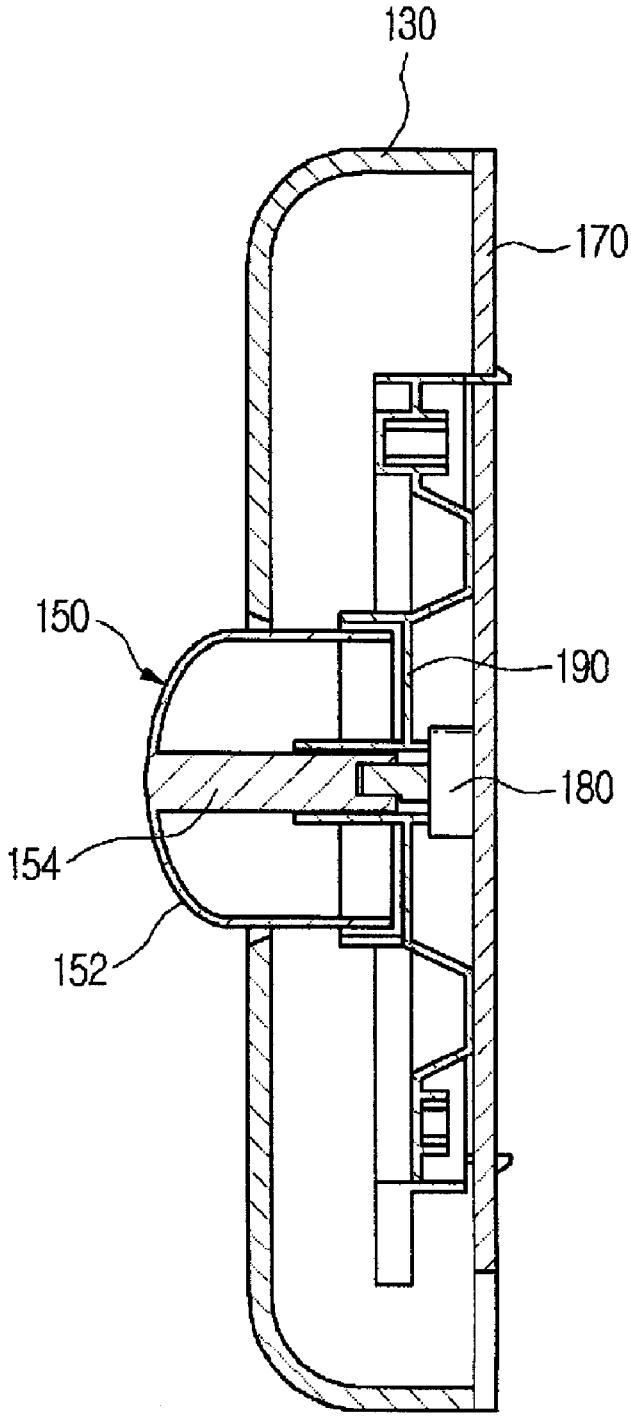
FIG. 2 (PRIOR ART)
FIG. 2 is a cross-sectional view illustrating a coupled state of a control button and a printed circuit board of the conventional washing machine of FIG. 1.
Figure 3:
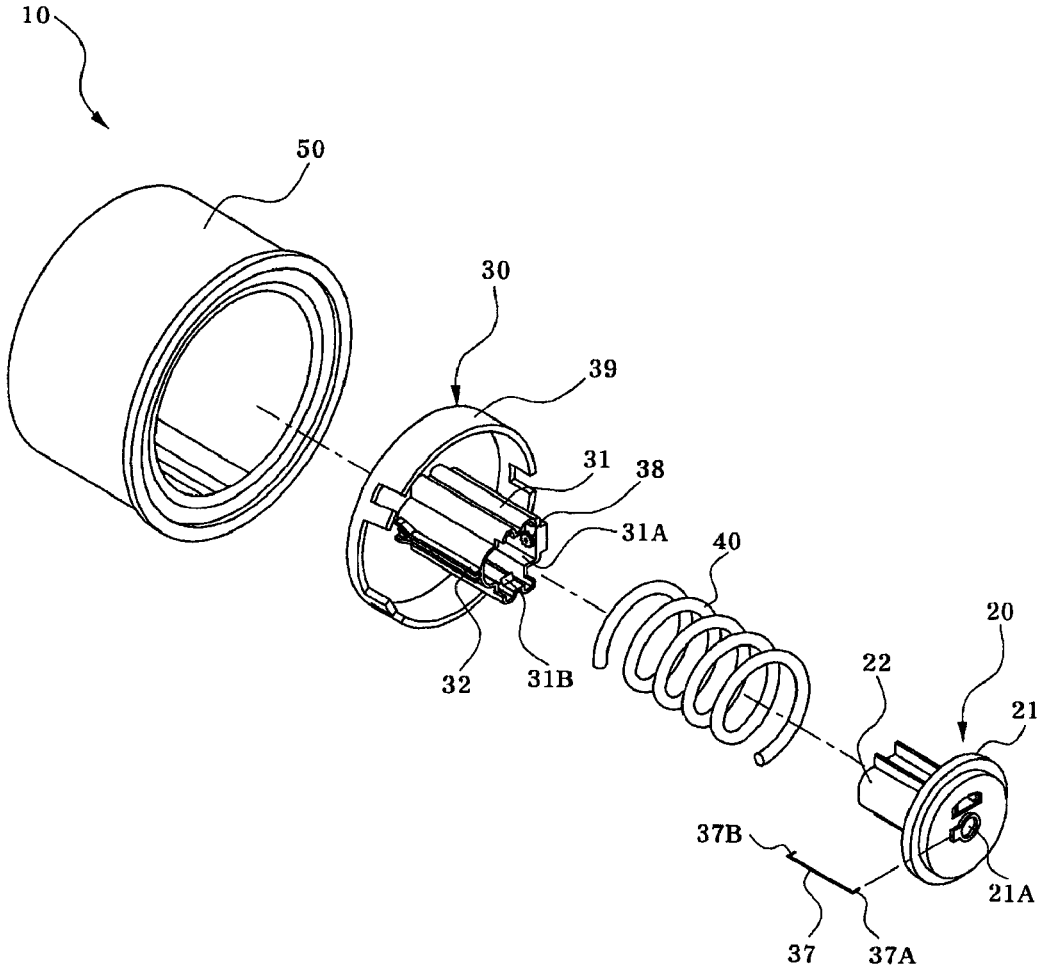
FIG. 3 is an exploded perspective view of a control button of a drum type washing machine according to one embodiment of the present invention.

Exemplary embodiments of the present invention will be described in detail with reference to the accompanying drawings. For descriptive convenience, the present invention will be described based on a control button of a drum type washing machine. The drawings may be exaggerated in thickness of lines or size of components for the purpose of descriptive convenience and clarity only.

Furthermore, terms used herein should be defined in consideration of functions of components of the present invention and thus can be changed according to the custom or intention of users or operators. Therefore, definition of such terms should be determined according to overall disclosures set forth herein.

Referring to FIGS. 3 to 6, the control button 10 of the drum type washing machine comprises a button securing part 20, a button operating part 30, an elastic member 40, and a button adjusting part 50.

The button securing part 20 is to be coupled to a rotary switch 60 disposed on a printed circuit board 80, and generally comprises a securing body 21, a securing portion 22 and a coupling hole 26.

The securing body 21 has a circular shape, and fitting hole 21A is formed at the center thereof. The securing portion 22 extends from one side of the securing body 21 and has a rack 23 formed on an outer surface of the securing portion 22.

The securing portion 22 has a plurality of securing hooks 25 formed on an outer peripheral surface of one end of the securing portion 22, and, the rack 23 is engaged with a pinion 38 described below and serves to reduce the speed of the control button 10 when the control button 10 is inserted into or protruded from a control panel 90.

The coupling hole 26 is in communication with the fitting hole 21A inside the securing portion 22 and is coupled to the rotary switch 60.

The button operating part 30 is to be coupled to one side of the button securing part 20, and comprises an operating portion 31, a guide member 32 and an operating body 39.

The operating portion 31 has an operating trough 31A formed therein, and a pinion 38 mounted within the operating trough 31A so as to be engaged with the rack 23, whereby the securing portion 22 of the button securing part 20 is coupled to the operating portion 31. Further, the operating portion 31 is open at one end thereof. Specifically, the open end of the operating portion 31 faces the button securing part 20.

The guide member 32 is formed along one side of the operating portion 31, and the operating body 39 is integral to one end of the guide member 32, and to an end of the operating portion 31 that is opposed to the open end.

Latch hooks 31B corresponding to the securing hooks 25 are formed on an inner peripheral surface at an inlet side of the operating trough 31A of the operating portion 31. The latch hooks 31B cooperatively engage the securing hooks 25 to prevent separation of the button operating part 30 from the button securing part 20.

Specifically, the guide member 32 generally comprises a guide protruding piece 33, a guide-piece controlling protrusion 35, a secondary guide-piece controlling protrusion 35A, and a guide piece 37. The guide piece 37 is an elongate, generally U-shaped member having a fixed end 37A and a movable end 37B.

The guide protruding piece 33 extends integrally on one side of an outer peripheral surface of the operating portion 31 in the longitudinal direction and has a guide-piece guiding portion 34 defined therein.

The guide-piece controlling protrusion 35 is formed on the guide-piece guiding portion 34 to divide the guide-piece guiding portion 34 to a first guide section 34A and a second guide section 34B. Here, the first guide section 34A indicates a first side (for example, the right side) of the guide-piece guiding portion 34 (see FIG. 5) and constitutes a passage along which the control button 10 moves when being inserted into the control panel 90. The second guide section 34B indicates a second side (for example, the left side) of the guide-piece guiding portion 34 and constitutes a passage along which the control button 10 moves when being extended from within the control panel 90.

Since the guide-piece controlling protrusion 35 has a leading corner located at one side (for example, a left side) of an imaginary straight line extending along a longitudinal axis of the guide piece 37, the movable end 37B of the guide piece 37 is guided toward the first guide section 34A by the leading corner of the guide-piece controlling protrusion 35 when the button adjusting part 50 is inserted into the control panel 90.

Further, the guide-piece controlling protrusion 35 is formed with a V-shaped guide groove 36 that faces the operating body 39 and is divided into a first slope 36A and a second slope 36B. Here, the first slope 36A indicates a right side of the guide groove 36 (see FIG. 5). The second slope 36B indicates a left side of the guide groove 36. When guided to the first guide section 34A, the movable end 37B is guided along the first slope 36A and seated on the guide groove 36, thereby completing insertion of control button 10 into the control panel 90.

Here, the first slope 36A of the guide groove 36 is longer than the second slope 36B to allow the movable end 37B of the guide piece 37 located on the guide groove 36 to be easily released from the guide groove 36 to permit operation of the button operating part 30 when using the washing machine.

The secondary guide-piece controlling protrusion 35A is formed on one side of the operating portion 31 contacting the operating body 39 and faces the guide groove 36 to allow the movable end 37B to be easily released from the guide groove 36. In this embodiment, the secondary guide-piece controlling protrusion 35A has a triangular shape, in which, assuming one side contacting the one side of the operating portion 31 is a base, another side perpendicular to the base is a height side, and the third side is a hypotenuse, a corner where the height side meets the hypotenuse is formed at a location biased to the first slope 36A side from an imaginary straight line extending from the center of the guide groove 36. With this configuration, when the button adjusting part 50 is pressed, the movable end 37B is moved from the guide groove 36 to the secondary guide-piece controlling protrusion 35A, slides along the hypotenuse of the secondary guide-piece controlling protrusion 35A to the second guide section 34B, and is then finally released.

The fixed end 37A of the guide piece 37 is secured to the button securing part 20 such that the movable end 37B can control the operation of the button operating part 30 while moving along the guide-piece guiding portion 34, the first guide section 34A, the second guide section 34B, and the like.

The elastic member 40 has one end mounted between the operating body 39 and the operating portion 31, and the other end mounted on the securing body 21 of the button securing part 20. As the button operating part 30 is moved toward the button securing part 20 after insertion of the control button 10, the elastic member 40 becomes compressed. When the movable end 37B of the guide piece 37 is released from the guide groove 36 by pressing the button adjusting part 50, the button operating part 30 is moved in a direction where restoration of the compressed elastic member 40 occurs, thereby allowing the control button 10 to extend outward relative to the control panel 90.

The button adjusting part 50 is provided to the control panel 90, and has a cylindrical shape, of which one end 52 is closed and the other end 56 is open. The operating body 39 of the button operating part 30 is press-fitted into the open end 56 of the button adjusting portion 50. The annular wall portion 54 of the button adjusting part 50 resides within an inserting hole 92 formed in the control panel 90 such that the closed end 52 is substantially flush with a surface of the control panel 90 when the control button 10 is in the retracted position, and the closed end 52 is positioned outwardly of the surface of the control panel 90 (FIG. 4) when the control button 10 is in the extended position.

Figure 4:
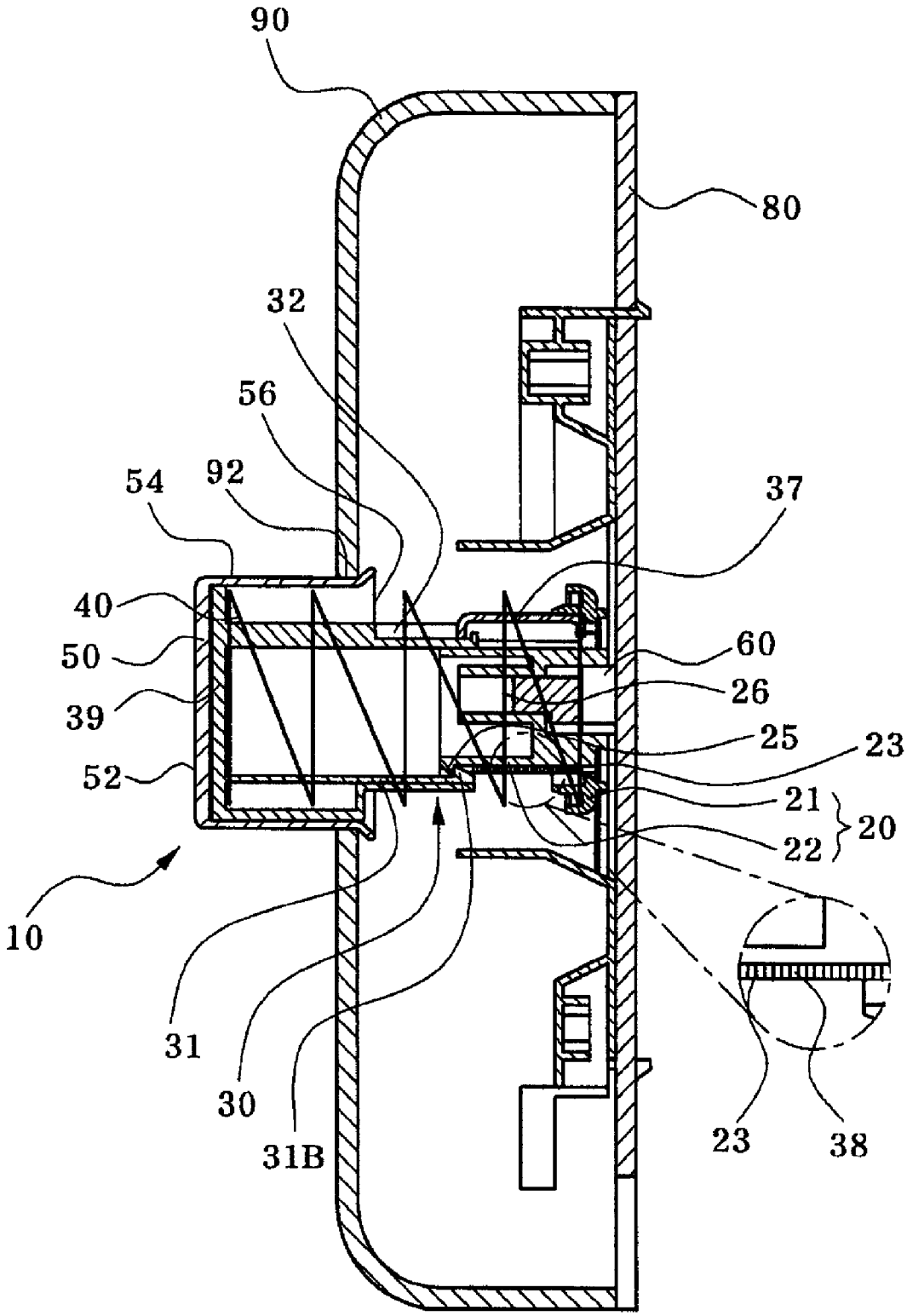
FIG. 4 is a cross-sectional view illustrating a coupled state of the control button and a printed circuit board of the washing machine according to the embodiment of the present invention.
Figure 5:
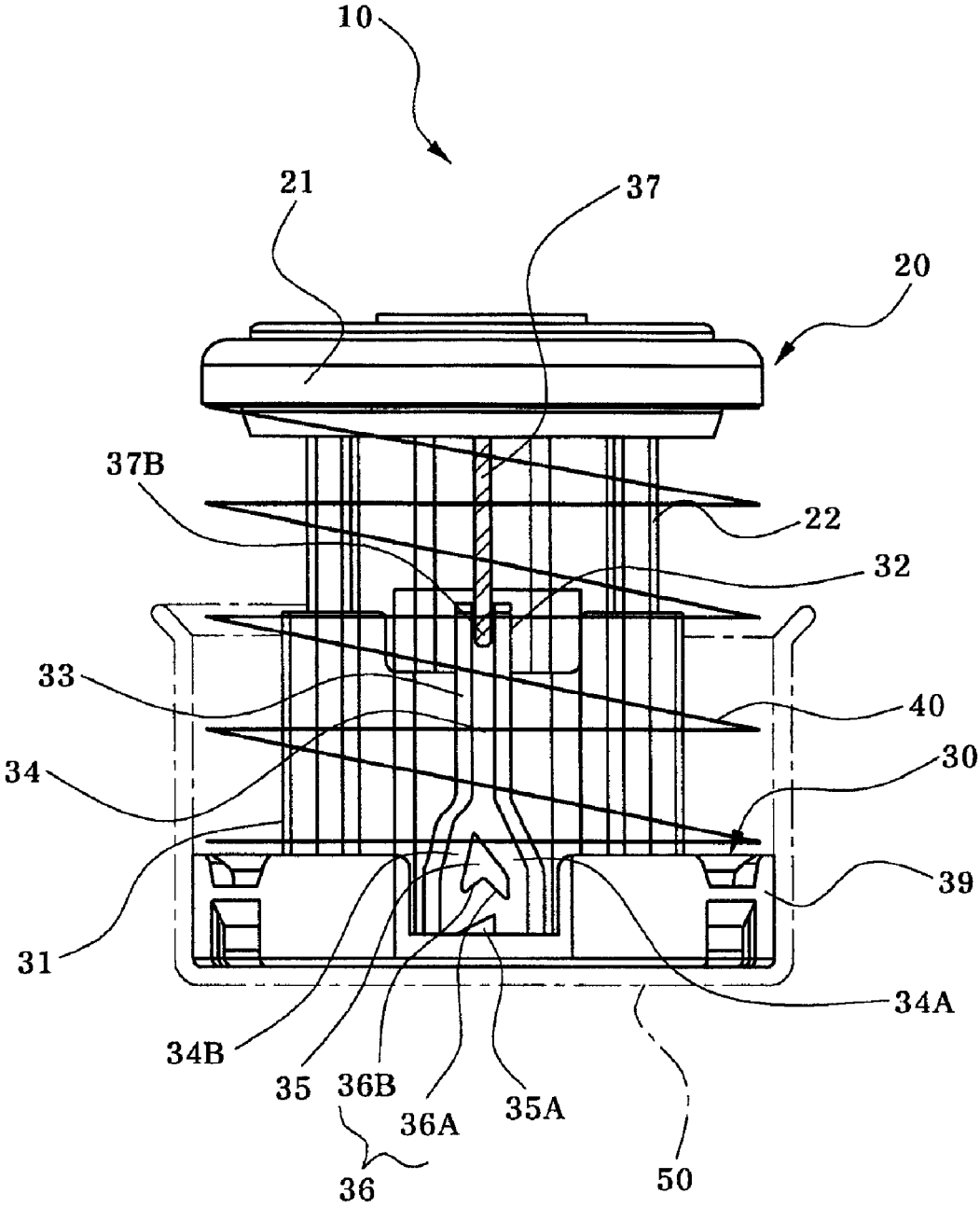
FIG. 5 is a front view of the control button illustrating the control button in an extended position according to the embodiment of the present invention.

The button securing part 20, button operating part 30 and button adjusting part 50 are made from a metallic material or a synthetic resin Next, an operating principle of the control button of the drum type washing machine according to one embodiment of the invention is described with reference to FIGS. 4 to 6.

The control button 10 of the drum type washing machine is coupled to the rotary switch 60 disposed on the printed circuit board 80 through the inserting hole 92 of the control panel 90. Then, when a user rotates the control button 10 toward a mark indicating a certain washing cycle among various washing cycles, the rotary switch 60 will be rotated by the rotation of the control button 10. The rotary switch 60 is provided for selectively inputting one of the various washing cycles, such as a standard cycle, wool/lingerie cycles, etc., to the printed circuit board 80, and enables the washing machine to perform the washing cycle selected by the user.

Next, principles of insertion and protrusion of the control button are described.

When the inserted button adjusting part 50 of the control button 10 is pressed, the button operating part 30 is moved inward by the compressive force to the button adjusting part 50. Then, the movable end 37B of the guide piece 37 located in the guide groove 36 is moved to the secondary guide-piece controlling protrusion 35A, and is guided to the second guide section 34B along the hypotenuse of the secondary guide-piece controlling protrusion 35A.

When the movable end 37B is released from the guide groove 36, the elastic member 40, which has been compressed between the button operating part 30 and the button securing part 20, is restored to its original state, and the button operating part 30 moves away from the button securing part 20. At this time, the movable end 37B is located at the other end of the guide protruding piece 33 after being moved along the second guide section 34B and the guide-piece guiding portion 34, and the button adjusting part 50 protrudes from the control panel 90 (see FIG. 5).

The button operating part 30 spaced from the button securing part 20 is not completely separated from button securing part 20 since the latch hooks 31B of the button operating part 30 are latched to the securing hooks 25 of the button securing part 20.

In this state, the user operates the washing machine to perform a selected washing cycle by rotating the control button 10 toward the selected washing cycle.

Further, after using the control button 10, the user pushes the control button 10 again to make the button adjusting part 50 retract into the control panel 90.

Specifically, when pushing the button adjusting part 50 of the control button 10 while it is protruding from the control panel 90, the button operating part 30 is moved toward the button securing part 20 by the compressive pushing force applied to the button adjusting part 50. Here, since the leading corner of the guide-piece controlling protrusion 35 is biased to a left side, the movable end 37B of the guide piece 37 is moved to the first guide section 34A from the guide-piece guiding portion 34. In this state, when further pressing the button adjusting part 50, the movable end 37B is guided to the first slope 36A of the guide groove 36 after moving along the first guide section 34A, and when the button adjusting part 50 is released, the movable end 37B is located and stopped at the center of the guide groove 36. That is, movable end 37B is located and stopped between the first slope 36A and the second slope 36B by the restoration force of the elastic member 40, after moving along the first slope 36A of the guide-piece controlling protrusion 35.

Figure 6:
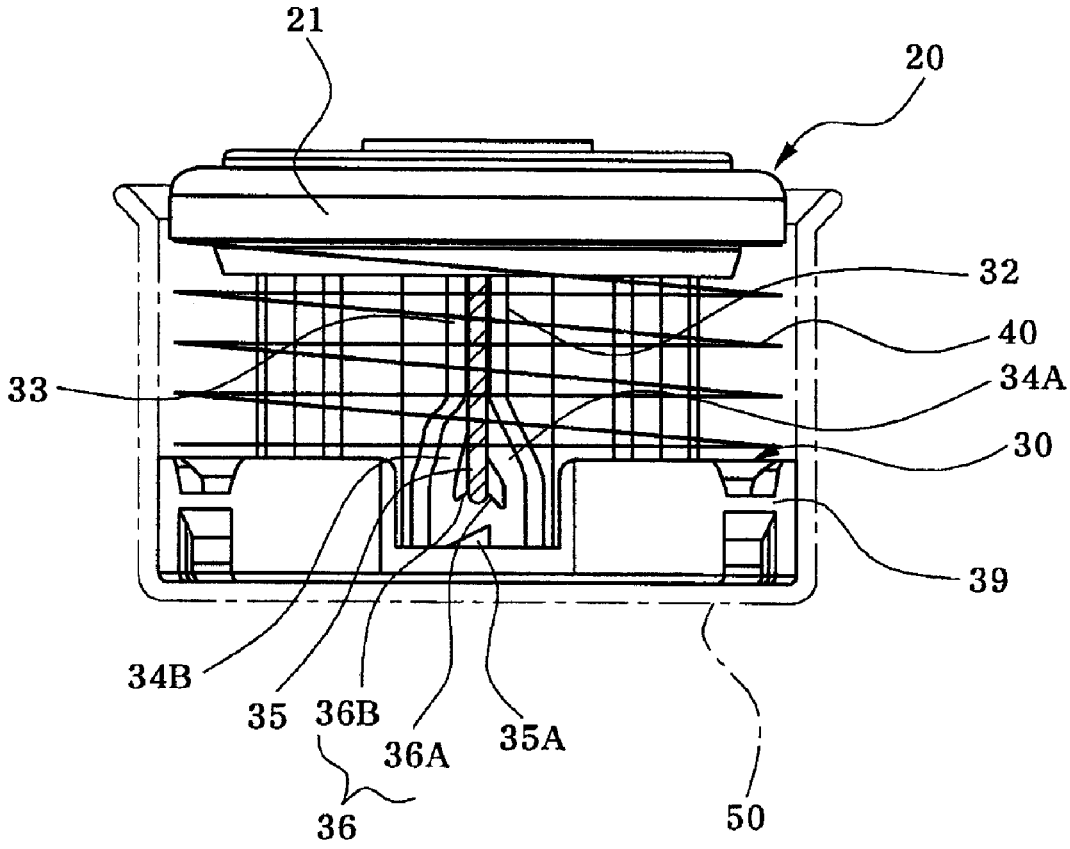
FIG. 6 is a front view of the control button illustrating the control button in a retracted position according to the embodiment of the present invention.

As a result, the separation between the button securing part 20 and the button operating part 30 is narrowed, and the button adjusting part 50 is retracted into the control panel 90 through the inserting hole 92 of the control panel 90, so that the button adjusting part 50 does not protrude from the control panel 90 (see FIG. 6).

Further, the configurations of the rack 23 formed on the button securing part 20 and the pinion 38 formed on the button operating part 30 corresponding to the rack 23 enable retraction and extension of the control button 10 with respect to the control panel to be performed more smoothly. With cooperation of the rack 23 and the pinion 38, it is possible to prevent reduction in coupling force between the button coupling part 20 and the button operating part 30, which can be caused by an accidental retraction or extension of the control button 10, while improving operating sensations experienced by the user when the control button 10 is inserted into or protruded from the control panel 90.

As apparent from the above description, the control button of the drum type washing machine according to the present invention can be retracted inside the control panel after use of the control button or when manipulation thereof is not required, thereby preventing unwanted manipulation of the control button, which can occur during use of the washing machine. With this construction, it is possible to prevent in advance an unintended change in a washing cycle. Furthermore, since the control button can be received inside the control panel, it is possible to prevent damage of the control button due to an accidental contact with external things.

Although the present invention has been described with reference to the embodiments and the accompanying drawings, these embodiments are provided for the illustrative purpose, and it will be apparent to those skilled in the art that various modifications and equivalent embodiments can be made from these embodiment disclosed herein.

Furthermore, although the present invention has been described based on the control button of the drum type washing machine as one example, the control button of the present invention can be applied to any kind of electronic appliance to prevent unwanted manipulation of the control button. Therefore, the scope of the present invention should be limited only by the accompanying claims.

What is claimed is:

1. A control button of a control panel for manipulating a rotary switch, the control button comprising:

a button securing part, including a securing body having a fitting hole formed at a center of the securing body, a securing portion extending from one side of the securing body and having a rack formed on an outer surface of the securing portion, and a coupling hole formed inside the securing portion so as to be in communication with the fitting hole, the coupling hole being coupled to the rotary switch;

a button operating part, including an operating portion open at one end and having an operating trough and a pinion corresponding to the rack disposed inside the operating portion, a guide member disposed at one side of the operating portion, and an operating body integral to one end of the guide member and to an opposed end of the operating portion;

an elastic member having one end mounted between the operating body and the operating portion, and the other end mounted on the button securing part; and a cylindrical button adjusting part provided on the control panel and having the operating body press-fitted into the button adjusting part, wherein the guide member comprises:

a guide protruding piece formed at one side of an outer peripheral surface of the operating portion and having a guide-piece guiding portion defined therein;

a guide-piece controlling protrusion formed on the guide-piece guiding portion which divides the guide-piece guiding portion, the guide-piece controlling protrusion including a guide groove which faces the operating body, the guide groove having a V-shape such that the guide groove comprises a first slope and a second slope; and a guide-piece having a moving end and a fixed end, the moving end capable of moving along the guide-piece guiding portion to control operation of the button operating part, and the fixed end secured to the button securing part, and wherein the guide-piece controlling protrusion has a corner facing the guide-piece and biased to one side of an imaginary straight line extending along a longitudinal axis of the guide-piece, the guide groove is formed on the imaginary straight line, and the elastic member is a cylindrical coil-spring having a diameter slightly smaller than that of the cylindrical button adjusting part.

2. The control button according to claim 1, wherein the guide member comprises a secondary guide-piece controlling protrusion formed on a surface of the operating portion so as to contact contacting the operating body, while facing the guide groove.

3. The control button according to claim 2, wherein the secondary guide-piece controlling protrusion has a corner facing the guide groove and biased to one side from an imaginary straight line extending from a center of the guide groove.

4. The control button according to claim 1, wherein the first slope of the guide groove is longer than the second slope.

5. The control button according to claim 1, wherein the button securing part, the button operating part, and the button adjusting part are made from a metallic material.

6. The control button according to claim 1, wherein the button securing part, the button operating part, and the button adjusting part are made from a synthetic resin.

7. The control button according to claim 1, wherein the rack cooperatively engages the pinion such that:

the securing portion is coupled to the operating portion; and the speed of the relative motion between the securing portion and the operating portion is governed.

8. The control button according to claim 1, wherein the control panel forms a portion of a cabinet of a washing machine such that the rotary switch permits selection of a washing cycle from a plurality of washing cycles.

* * * * *